US007798747B1

(12) United States Patent
de Bruijn et al.

(10) Patent No.: US 7,798,747 B1
(45) Date of Patent: Sep. 21, 2010

(54) STORMWATER CAPTURE MODULE

(75) Inventors: Hans de Bruijn, Lancaster, PA (US); Dale Groff, Lititz, PA (US); E. Nelson Martin, Terre Hill, PA (US)

(73) Assignee: Terre Hill Silo Co., Inc., Terre Hill, PA (US)

( * ) Notice: Subject to any disclaimer, the term of this patent is extended or adjusted under 35 U.S.C. 154(b) by 685 days.

(21) Appl. No.: 11/589,437

(22) Filed: Oct. 30, 2006

(51) Int. Cl.
*E01F 5/00* (2006.01)

(52) U.S. Cl. ..... 405/125

(58) Field of Classification Search ..... 405/124–126
See application file for complete search history.

(56) References Cited

U.S. PATENT DOCUMENTS 1,144,200 A * 6/1915 Hewett ..... 405/125
1,197,966 A * 9/1916 Sweney ..... 138/100
3,416,321 A 12/1968 Saad
4,564,313 A * 1/1986 Niswander et al. ..... 405/125
5,890,838 A 4/1999 Moore, Jr.
6,161,342 A * 12/2000 Barbier et al. ..... 52/86
6,206,607 B1 3/2001 Medico, Jr.
6,474,907 B2 * 11/2002 Semotiuk et al. ..... 405/126
6,612,777 B2 9/2003 Maestro
6,854,925 B2 2/2005 DiTullio
6,991,402 B2 * 1/2006 Burkhart ..... 405/36
2002/0076280 A1 * 6/2002 Semotiuk et al. ..... 405/124

* cited by examiner

*Primary Examiner*—Tara Mayo-Pinnock
(74) *Attorney, Agent, or Firm*—Martin Fruitman

(57) ABSTRACT

The apparatus is an underground reservoir to capture and slowly release stormwater runoff from impervious surfaces such as roads, rooftops, and parking areas. The structure is assembled from one or more modules comprising at least two side by side precast fiber reinforced concrete vaulted shaped chambers, each with side walls and an arch top. The side by side chambers have common walls with openings in the walls. Modules placed end to end are mated at reinforced concrete end walls that include lifting pins for moving the module. Ends of the chambers are closed, but the end walls have openings for feeding stormwater in and venting air out.

8 Claims, 2 Drawing Sheets

STORMWATER CAPTURE MODULE

BACKGROUND OF THE INVENTION

This invention deals generally with subsurface structures for detention, retention and ground infiltration of stormwater runoff, and more specifically with a modular concrete structure composed of two or more side by side vault shaped chambers.

Many laws and regulations exist that require the slow release of stormwater into the aquifer, while the somewhat conflicting requirement for traffic safety is for quick drainage of water from roadways. Laws and regulations also exist that require the slow release of stormwater to open water ways and the aquifer and the recharge of the aquifer with all the water from small storms. Although this problem was once addressed by merely constructing drainage basins a short distance from roadways, the value of land, particularly in urban and suburban areas, makes surface drainage basins impractical. One solution to this problem is to put stormwater retention and infiltration structures underground. For road construction, such structures can even be installed directly below the roadway.

A common structure used for this purpose is an arch shaped corrugated molded plastic chamber. Such structures are disclosed in U.S. Pat. Nos. 5,890,838 to Moore, Jr. et al; 6,612,777 to Maestro; and 6,854,925 to DiTullio. However, the cost of such molded plastic structures is significant because the cost must cover the expensive mold. Another commonly use solution is the installation of concrete pipe or metal pipe. The installation of these structures is labor intensive because they are multiple single components, each of limited volume. The structures must provide a structurally stable foundation, which involves serious compaction requirements of the backfill that also is very labor intensive and impractical due to the shape of the structures and their placement relative to each other. The plastic structures suffer from material weaknesses that compromise the structural stability because plastic is subject to relaxation and creep of the material that are in excess of what is acceptable, and this has led to subsidence of the grade levels above the structures. The metal structures corrode and have a relatively short live span compared to un-reinforced concrete. Moreover, there is little ability to customize any such structure except for cutting shorter segments off the standard product.

It would be very beneficial to have available a shallow subsurface detention or retention and infiltration structure to accommodate to the surface area that needs drainage, to the quantity of stormwater runoff to which the surface is subjected, that can be installed with common construction equipment such as front-end loaders, backhoes, or small cranes, and which also covers substantially more area with one placement than can be covered with the single pipe or arched sections used until now. Furthermore, it would be very beneficial to be able to place backfill on top of the structure to become the work surface for setting the next section. It also would be beneficial to have available a subsurface retention and infiltration structure that can easily be customized to accommodate to the width and the length of a surface that needs drainage and to the quantity of stormwater runoff to which the surface or roadway is subjected. It would be even more desirable if such structures could be constructed and installed at costs less than the previously described systems.

SUMMARY OF THE INVENTION

The present invention is a subsurface stormwater retention and ground infiltration structure that is assembled from one or more modular sections, and individual site installations can therefore be customized by using several modules side by side or end to end. Each module is constructed of two or more side by side attached chambers made of precast fiber reinforced concrete, and each chamber is tunnel shaped, has an arch top, and can have vertical side walls to increase its internal volume. The side by side chambers in each module have common walls that can have opening to distribute the water between the chambers. Although the modules are typically constructed without floors and rest upon a porous stone surface prepared to encourage infiltration, the modules can also be placed on floors to form a watertight detention structure connected to a slow release outlet structure or can be placed on poorly drawing soil to become a slow release structure.

Each module has a reinforced concrete wall on each end that includes lifting pins to lift the module for transport and openings for feeding in stormwater. The end walls at least partially close off the chambers to prevent soil from filling the interior. Modules can be placed end to end and mated at their end walls to form longer structures, and openings are located in the end walls to permit water equalization between such end to end modules. Openings can also be formed in the end walls to release excess water in a controlled manner.

The modules are made in dimensions and with weights that allow them to be easily transported to construction sites on trucks and loaded and unloaded with typical on-site equipment. This weight limitation is accomplished by using thin walled fiber laden concrete walls. The chambers have the classic shape of a Roman arch with semi-circular chamber ceilings or other suitable curved chamber ceilings and vertical parallel walls, and with the inherent compressive strength of concrete, they function very well when covered by earth or other fill. Vertical perimeter walls exposed to earthen loads may be reinforced with buttress reinforcement structures or L-Shaped structures to oppose inward thrust from the soil. The end walls which are vertical and perpendicular to the chamber side walls act as lifting beams, and they are formed integrally with the sidewalls and the arches of at least two side by side chambers.

The design accommodates to the two different mechanical conditions to which it is subjected from its point of manufacture to its operation after installation. The end walls are the key to moving the modules during loading and unloading onto a truck, but see little stress once the module is installed. While the module is being lifted by means of the lifting pins installed in the end walls, the end-walls support the entire module. The reinforcing furnished by the synthetic fiber fill in the concrete provides all the strength needed during this temporary tensile stress. Similarly, the arches, which are relatively passive while in transit, also include synthetic fiber reinforcing in the concrete which counteracts secondary tensile loads during transit, while the inherent compressive strength of concrete supports the compressing load after the modules are installed underground.

The synthetic fiber fill in the concrete also increases the life expectancy because it eliminates the potential of corrosion of metal rebar while reducing the assembly weight. Furthermore, the thin walled fiber laden concrete of the present invention is stronger and more durable than the previously used corrugated plastic or galvanized metal chamber walls.

The present invention thereby combines the physical strength of the arch structure with the compressive strength of concrete to furnish a versatile precast concrete subsurface stormwater retention and infiltration structure that requires no special equipment and relatively little labor to install.

DETAILED DESCRIPTION OF THE INVENTION

Figure 1:
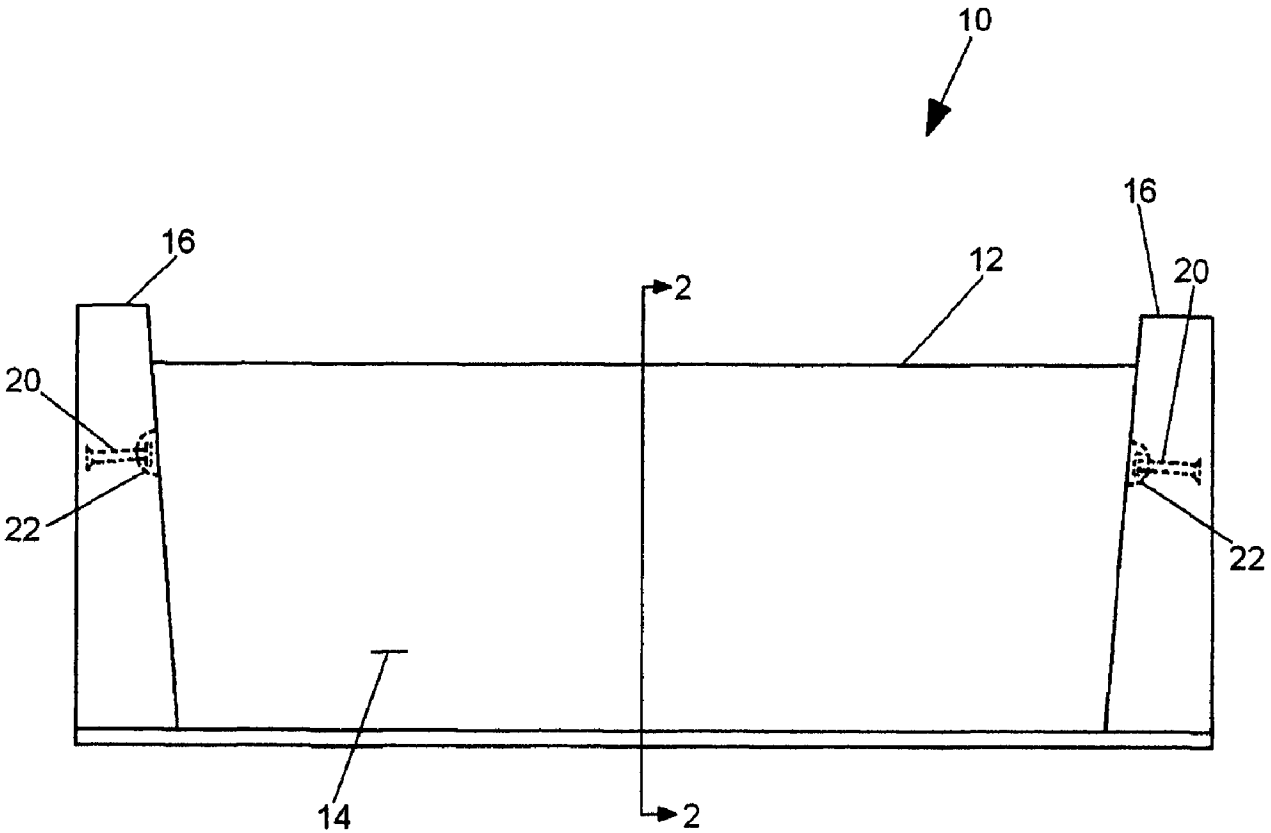
FIG. 1 is a side view of a module of the preferred embodiment of the invention.
Figure 2:
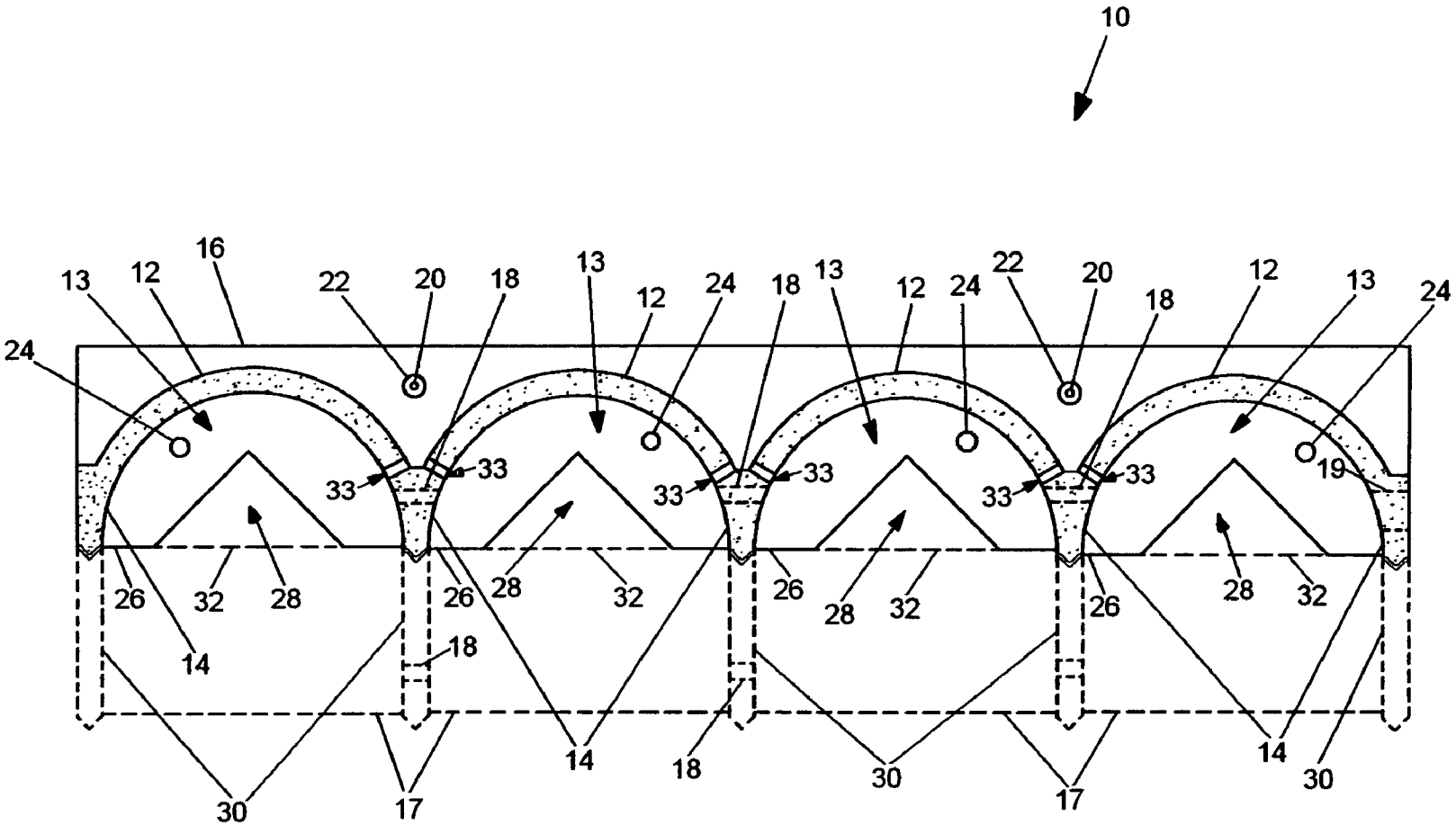
FIG. 2 is a cross section view of the module of the preferred embodiment of the invention at the cross section line 2-2 shown in FIG. 1.

FIG. 1 is a side view of module 10 of the preferred embodiment of the invention, and FIG. 2 is a cross section view of module 10 at cross section line 2-2 shown in FIG. 1. FIG. 2 also shows several useful alternatives of the invention.

Module 10 is precast of fiber reinforced concrete to form tunnel shaped chambers 13 from bell shaped arches 12, arch terminating side walls 14 with vertically oriented lower ends, optional vertical side wall extensions 30, and end walls 16. In the preferred embodiment, arches 12 are semicircles in their cross sections, and side walls 14 and end walls 16 are vertical walls. The preferred embodiment of module 10 includes four side by side chambers 13 with common side walls 14, but module 10 can easily be constructed of two or more chambers 13 depending upon the application and the transportation capability. Side walls 14 can be formed with through holes 18 to permit stormwater flow between chambers in order to better equalize the quantity of stormwater in each chamber. Optional through holes 19 can also be formed in outermost side walls 14 when they are side walls that are not common with another chamber. This permits equalization of water levels between abutting side by side modules.

End walls 16 partially close off chambers 13 to prevent soil from filling the interior. End walls 16 span between arches 12 and extend to a height at least as high as the tops of arches 12, and they can include stormwater entry and air venting openings 24 that can be located almost anywhere in chambers 13. Lifting fixtures 20 are installed within cavities 22 located on the inside surface of end walls 16 but outside of chamber arches 12. When suitable lifting equipment is attached to the four lifting fixtures 20 of module 10, the lifting load is balanced, and the module can easily be moved from a truck to the final location in the field.

Module 10 of the preferred embodiment is nominally 8 feet long including end walls 16 and is nominally 19 feet wide across the four chambers. The shorter height is determined by the height of only arches 12 and is 2.5 feet. This is the height shown in FIG. 1 and indicated in FIG. 2 by solid lines and bottom lines 26 of end wall 16. This size is quite suitable for transportation on trucks without any requirement for special permits, and, particularly because of the thin wall sections of fiber reinforced concrete, results in a weight that is easily handled by conventional on-site construction equipment.

It should be appreciated that the function of chambers 13 is to accumulate stormwater running off from roadways or other surfaces that do not permit water to soak into the ground, and to permit it to slowly infiltrate into the ground. To that end module 10 is typically installed atop a surface such as a bed of crushed stone that is specifically prepared to permit water to infiltrate slowly through the surface and into the ground. However, there are times during heavy storms when the quantity of runoff can exceed the volume of even the largest storage module. To overcome this problem, modules can be constructed with overflow openings 28 in end walls 16. Such openings can also be weirs or orifice discharge openings and permit the excess stormwater to leave the chambers. Overflow openings 28 also facilitate the layout of modules in an end to end configuration. Such arrangements of modules in end to end and also in side by side patterns are the appropriate solution in locations where stormwater runoff is excessive. It should be appreciated that overflow openings 28 need not be in the shape or at the location shown, but can actually be any shape, size, or location on end wall 16 that is needed for the particular application.

FIG. 2 also shows several modifications easily formed into module 10 during the original casting process. These alternatives are indicated with dashed lines. Side wall extensions 30 and end wall extensions 17 that extend in a direction away from arches 12 are used to increase the size of chambers 13 and can dramatically increase the volume of stormwater retained by module 10. Side wall extensions 30 can either be constructed integral with arches 12 or be independent structures which mate with side walls 14. Drain holes 33 located near the junction of the arches prevent accumulation of water and allow additional storage of water in the void spaces of the washed stone surrounding the structure.

Another alternative feature for module 10 is the addition of floors 32 in chambers 13. Such floors, with suitable openings for drainage, can be used when the ground at the installation site will not properly support the weight of the entire module, since the weight is concentrated at the small total of the surface area of the bottoms of side walls 14 and end walls 16. Module 10 also can be used as a below grade retention structure when floors 32 are without holes and the floors are sealed.

The present invention thereby furnishes a versatile prefabricated detention, retention, and infiltration module that can be easily installed without special skills, and multiple modules can be laid out in end to end or side by side patterns to accommodate virtually any stormwater runoff requirements.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims. For example, other shapes and locations of overflow openings 28 and drain holes 33 may be used. Furthermore, end walls 16 can be modified to fully open the chamber ends of interior modules that are part of a configuration formed of several modules installed end to end, since there is no concern for soil entering those interior modules.

What is claimed as new and for which Letters Patent of the United States are desired to be secured is:

1. A precast unitary module for stormwater retention and infiltration comprising at least two side by side tunnel shaped chambers with common walls between the chambers and the top of each chamber formed as an arch with side walls and including end walls attached to the ends of the chambers and partially closing off the chamber ends sufficiently to cause some liquid to be retained within the module and to also permit liquid to flow out of the chamber ends, and further including a lifting fixture attached to the module to permit the attachment of lifting devices to the module.

2. The module of claim 1 wherein the side walls and common walls terminate with vertically oriented lower ends.

3. The module of claim 1 wherein the arches at the top of the chambers are extended with vertical walls.

4. The module of claim 1 wherein the arches of the chambers are supported by independent vertical walls that mate with the arches.

5. The module of claim 1 further including end walls attached to the ends of the chambers and at least partially closing off the chamber ends sufficiently to cause some liquid to be retained within the module and to also permit liquid to flow out of the chamber ends and wherein the tops of the end walls are located at least as high as the tops of the arches and span between the arches.

6. The module of claim 1 further including at least one lifting fixture attached to each end of the module to permit the attachment of lifting devices to the module.

7. The module of claim 1 further including at least one opening into each chamber to permit stormwater to directly enter each chamber from outside the module.

8. The module of claim 1 further including integrally constructed vertical extensions of the sidewalls, common walls and the end walls in a direction away from the arches to increase the volumes enclosed by the chambers.

* * * * *